US008692474B2

(12) United States Patent
McNay

(10) Patent No.: US 8,692,474 B2
(45) Date of Patent: Apr. 8, 2014

(54) ELECTRONIC BALLAST CIRCUIT FOR LAMPS

(75) Inventor: Steve McNay, Seymour, TN (US)

(73) Assignee: Genesys Systems, LLC, Ashville, NC (US)

( * ) Notice: Subject to any disclaimer, the term of this patent is extended or adjusted under 35 U.S.C. 154(b) by 640 days.

(21) Appl. No.: 12/938,360

(22) Filed: Nov. 2, 2010

(65) Prior Publication Data

US 2011/0101879 A1 May 5, 2011

Related U.S. Application Data

(60) Provisional application No. 61/257,194, filed on Nov. 2, 2009.

(51) Int. Cl.
*H05B 37/02* (2006.01)
*H05B 39/02* (2006.01)

(52) U.S. Cl.
USPC ..... 315/219; 315/209 R

(58) Field of Classification Search
USPC ..... 315/219, 209 R, 246, 247, 244
See application file for complete search history.

(56) References Cited

U.S. PATENT DOCUMENTS

| | | | | |
|---|---|---|---|---|
| 5,414,327 | A * | 5/1995 | Reijnaerts | 315/219 |
| 5,550,438 | A * | 8/1996 | Reijnaerts | 315/219 |
| 5,925,990 | A * | 7/1999 | Crouse et al. | 315/307 |
| 5,982,109 | A * | 11/1999 | Konopka et al. | 315/209 R |
| 6,121,734 | A | 9/2000 | Szabados | |
| 6,211,623 | B1 | 4/2001 | Wilhelm et al. | |
| 6,262,542 | B1 | 7/2001 | Kim et al. | |
| 7,019,468 | B2 | 3/2006 | Deurloo et al. | |
| 7,098,607 | B2 * | 8/2006 | Yu et al. | 315/291 |
| 7,154,232 | B2 | 12/2006 | Contenti et al. | |
| 7,378,804 | B2 * | 5/2008 | Mitsuyasu et al. | 315/247 |
| 7,525,256 | B2 | 4/2009 | Ribarich et al. | |
| 2001/0054887 | A1 | 12/2001 | Baretich et al. | |
| 2002/0141129 | A1 | 10/2002 | Ribarich | |
| 2003/0094908 | A1 | 5/2003 | Nerone et al. | |
| 2003/0168997 | A1 * | 9/2003 | Nishimoto et al. | 315/291 |
| 2004/0155635 | A1 | 8/2004 | Inaba | |
| 2004/0160152 | A1 | 8/2004 | Onishi et al. | |
| 2004/0263089 | A1 | 12/2004 | Contenti et al. | |
| 2005/0035729 | A1 | 2/2005 | Lev et al. | |

(Continued)

FOREIGN PATENT DOCUMENTS

| | | | |
|---|---|---|---|
| CN | 2121108 | U | 11/1992 |
| CN | 101472376 | A | 7/2009 |

OTHER PUBLICATIONS

Ribarich, Tom, Better Ballasts for HID Lighting, Energy Efficiency & Technology, Sep./Oct. 2010, 18-23. EETmag.com.

(Continued)

*Primary Examiner* — Minh D A
(74) *Attorney, Agent, or Firm* — Womble Carlyle

(57) ABSTRACT

An electronic ballast circuit includes a power factor correction circuit, a control and amplifier circuit, a ballast controller circuit and a ballast driver circuit. The ballast driver circuit includes a resonant circuit that connects to a lamp and a strike voltage limiter circuit that regulates the behavior of the resonant circuit. An overcurrent sensor circuit may be included to indirectly the control the ballast controller circuit via the control and amplifier circuit. The strike voltage limiter circuit uses varistors to change the resonant frequency of the resonant circuit to limit the voltage to the lamp.

27 Claims, 12 Drawing Sheets

BALLAST DRIVER AND VL

(56) References Cited

U.S. PATENT DOCUMENTS

| | | | | |
|---|---|---|---|---|
| 2006/0261739 | A1 | 11/2006 | Lee et al. | |
| 2007/0040516 | A1 | 2/2007 | Chen | |
| 2007/0052373 | A1* | 3/2007 | Hui et al. | 315/291 |
| 2008/0042595 | A1 | 2/2008 | Ribarich | |
| 2008/0180037 | A1 | 7/2008 | Srimuang | |
| 2008/0205104 | A1* | 8/2008 | Lev et al. | 363/98 |
| 2008/0272748 | A1 | 11/2008 | Melanson | |
| 2009/0021174 | A1 | 1/2009 | Feldtkeller et al. | |
| 2009/0033236 | A1* | 2/2009 | Alexandrov | 315/224 |
| 2009/0218953 | A1* | 9/2009 | Nerone et al. | 315/200 R |
| 2009/0225559 | A1 | 9/2009 | Cheng et al. | |

OTHER PUBLICATIONS

International Search Report for PCT/US2010/055189, ISA/US, Mar. 1, 2011.

Extended Search Report dated Jul. 9, 2013 issued in European counterpart application (No. 10827676.7).

Official Action dated Dec. 4, 2013 issued in Chinese counterpart application (No. 201080060369.1) with English Translation.

* cited by examiner

CONTROL AND AMP

DIMMER INTERFACE AND SUPPORT

BALLAST DRIVER AND VL

EMI Filter & Rectifier Bridge

Power Factor Correction Circuit

Control and Amplification Circuitry

Voltage Regulator

Ballast Controller & Ballast Driver

Dimmer Circuit & Current Limit Sensor 660
174
160
162
156
410
440
450
460
182a
182b
Q110
C129
EXT PWR OPT (25MA MAX)
CBUS
AUX_+
AUX_-
DIM+
DIM-
DIMPC
DIMTE
DRVOC
VCCD
VCC
U103 LM2904AD
U104 4N35SV
U105 4N35SV

ELECTRONIC BALLAST CIRCUIT FOR LAMPS

RELATED APPLICATIONS

This application claims priority to U.S. Provisional Patent Application No. 61/257,194, filed Nov. 2, 2009, the contents of which are incorporated by reference in their entirety.

BACKGROUND

This invention pertains to ballast circuits for lamps, such as high-intensity discharge lamps and fluorescent lamps. More particularly, this invention pertains to circuits for power limit characterization, current limiting, and voltage limiting for lamps driven by a ballast circuit.

SUMMARY OF THE INVENTION

In one aspect, the invention is directed to an electronic ballast circuit for limiting lamp strike voltage, comprising a ballast driver circuit which includes a resonant circuit having a first resonant frequency configured to drive a lamp, and a voltage limiter circuit connected to said resonant circuit.

The first resonant frequency may change to a second resonant frequency when a lamp voltage exceeds a threshold voltage, whereby said lamp voltage is clamped to said threshold voltage.

The resonant circuit may further comprise a first inductor connected in series with a run capacitor and a strike capacitor, with the lamp connected across the strike capacitor, and the voltage limiter circuit is connected across the run capacitor.

The voltage limiter circuit may comprise: a first varistor, a strike voltage charge high side capacitor and a first diode connected in series between a high side of the run capacitor and a common voltage; a second varistor, a strike voltage charge low side capacitor and a second diode connected in series between a low side of the run capacitor and said common voltage, wherein the first diode is arranged to conduct in a first direction and the second diode is arranged to conduct in a direction opposite to the first direction.

The voltage limiter circuit may further comprise a third varistor bridging a first point located between the strike voltage charge high side capacitor and the first diode and a second point located between the strike voltage charge low side capacitor and the second diode.

The common voltage may be derived from a voltage divider formed by first and second capacitors connected across a pair of bus lines.

The ballast driver circuit is devoid of a resistor configured for detecting current conditions therein to mitigate power consumption and generation of heat.

In another aspect, the invention is directed to an electronic ballast circuit comprising:

a ballast controller circuit configured to output at least one drive signal;

a power factor correction circuit outputting a current sense signal reflective of a voltage;

a control and amplifier circuit configured to receive said current sense signal, provide a power correction feedback signal to the power factor correction circuit, and provide one or more output signals to control the ballast controller circuit;

a ballast driver circuit configured to receive said at least one drive signal from the ballast controller circuit, the ballast driver circuit comprising:

a resonant circuit that connectable to a lamp; and a voltage limiter circuit configured to regulate behavior of the resonant circuit; and an overcurrent sensor circuit configured to output a signal to the control and amplifier circuit to thereby indirectly control the ballast controller circuit via the control and amplifier circuit.

In yet another aspect, the invention is directed to an electronic ballast circuit which includes a power factor correction circuit, a control and amplifier circuit, a ballast controller circuit and a ballast driver circuit. The ballast driver circuit includes a resonant circuit that connects to a lamp and a voltage limiter circuit that regulates the behavior of the resonant circuit. An overcurrent sensor circuit may be included to indirectly the control the ballast controller circuit via the control and amplifier circuit.

BRIEF DESCRIPTION OF THE DRAWINGS

The above-mentioned features of the invention will become more clearly understood from the following detailed description of the invention read together with the drawings in which.

DETAILED DESCRIPTION OF THE INVENTION

Figure 1:
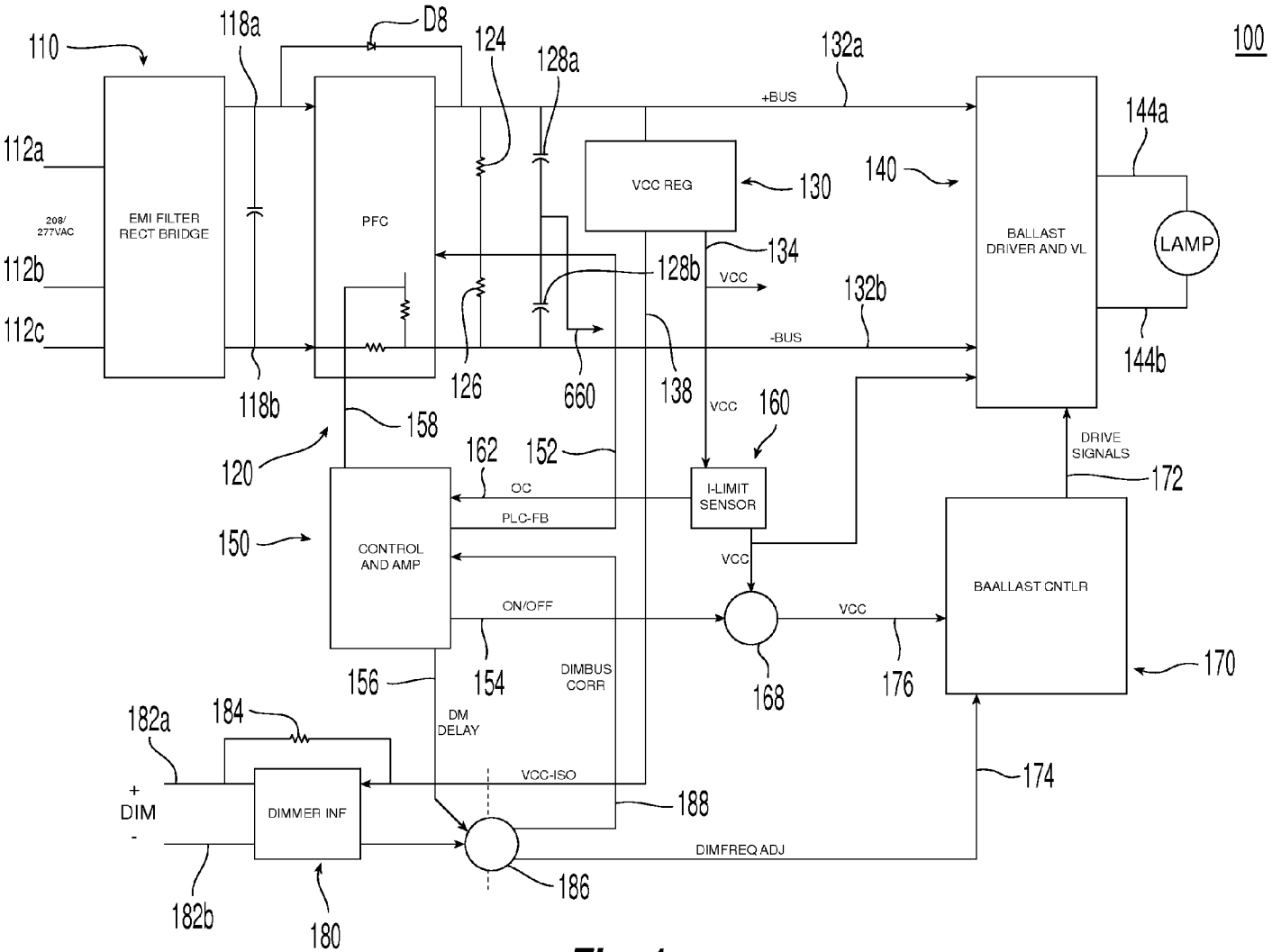
FIG. 1 is a block diagram of an electronic ballast in accordance with one embodiment of the present invention.

FIG. 1 shows a block diagram of one embodiment of an electronic ballast 100 in accordance with one embodiment of the present invention. The ballast 100 is configured to drive a lamp 602, for example, a high-intensity discharge (HID) lamp, such as the M132/M154, which has a rating of 320 watts with a voltage rating of 135 volts. Such a lamp 602 is suitable for lighting large areas, such as parking lots or warehouses. The ballast 100 for such a lamp 602 is connected to a power source of 208 Vac, 240 Vac, or 277 Vac. The ballast 100 provides a strike voltage of 3 to 4 KV peak and operates at a frequency of approximately 100 KHz. Those skilled in the art will recognize that these values will vary with the lamp manufacturer's specifications and recommendations without departing from the spirit and scope of the present invention.

The ballast 100 includes an EMI filter and rectifier bridge ("power supply") circuit 110, a power factor controller circuit 120, a VCC regulator circuit 130, a ballast driver circuit 140, a control and amplifier circuit 150, an overcurrent sensor circuit 160, a ballast controller circuit 170 and a dimmer circuit 180. Additional components and functionalities are also present in the circuit 100.

The ballast 100 regulates the current flowing through a load, such as a lamp 120. The ballast 100 is an electronic ballast that, in one embodiment, simulates the voltage versus wattage curve of a reactor ballast. The ballast 100 has features that limit lamp strike current and voltage.

The EMI filter and rectifier bridge circuit 110 serves as a power supply 110 which provides power to the circuitry of the ballast 100 and the lamp 602. The power supply 110 accepts first and second power inlets 112*a*, 112*b* and also has a ground input 114. The power supply 110 outputs a filtered, rectified sinewave onto power lines 118*a*, 118*b*. The EMI filter and rectifier bridge circuit 110 connects downstream, via power lines 118*a*, 118*b*, to the power factor controller (PFC) circuit 120 via PFC input capacitor 116 connected across the power lines 118*a*, 118*b*.

The PFC circuit 120 receives a power correction feedback signal 152 from the control and amplifier circuit 150. The PFC circuit 120 adjusts the voltage of +Main bus 132*a* in response to the power correction feedback signal 152. The PFC circuit 120 outputs a current sense signal 158 which is used by other components in the ballast circuit 100. The generation and implementation of signals 152, 158 is described in detail further below. The PFC circuit 120 aims to keep the power factor as close to 100% as possible in order to provide as high a real load to the power source 110 as possible, in order to satisfy IEC61000-3-2 requirements, and to improve efficiency. It is common for reactive ballasts to have a low power factor. The PFC circuit 120 is provided with a power limit characterization capability that allows the ballast 100 to approximate the voltage versus wattage characteristics of a reactive ballast. Downstream of the PFC circuit 120 is the ballast controller circuit 170, which is the circuit that provides the bias signal to the ballast driver circuit 140.

The ballast driver circuit 140 provides the power at an appropriate frequency to a resonant circuit 620, which drives the lamp 602. Associated with the ballast driver circuit 140 is a lamp strike voltage limiter (VL) circuit 610 that limits the strike voltage applied to the lamp 602 via lamp power leads 144*a*, 144*b*, thereby aiding to increase lamp longevity.

The VCC regulator circuitry 130 receives power from the +Main bus 132*a* and outputs a first voltage on the VCC bus 134 which is connected to various other components. The VCC regulator circuitry 130 also includes an isolation transformer T100 from which it outputs an isolated power signal VCC-ISO 138. The Vcc bus 134 is powered by the main bus 132*a*; 132*b*. The bus filter capacitors 128*a*, 128*b* are connected across the main bus. Therefore, the voltage of the main bus 132*a*, 1326 corresponds to the voltage of the bus filter capacitors 128*a*, 128*b*. In this way the current to the lamp 602 is interrupted when the voltage of the bus filter capacitors 128*a*, 128*b* falls below a threshold value. In addition, there is a minimum drive voltage required to sustain the lamp 602 just by the nature of the lamp's physics. The voltage regulator circuit 130 is capable of producing Vcc voltage from the main bus 132*a*, 132*b* at below the lamp's sustain level. The voltage regulator circuit 130 can be thought of as the 'last-circuit-standing.' The lag in the Vcc shutdown is to accommodate power line interruptions, with an attempt to 'carry-thru' the temporary outage. In one embodiment, the voltage regulator circuit 130 carries the lamp 602 thru 8 cycles of 60 Hz, but must retain the control status for recovery via the Vcc voltage that is applied to the control circuitry, if in the case the lamp 602 has not gone out. The voltage regulator circuit 130 has a different situation on power-up of the ballast. The voltage regulator circuit 130 has an MOV (not shown) in FIG. 1 that is connected its start-up bias pinto prevent the voltage regulator circuit 130 from starting at power line voltage levels less than a minimum value, for example, 190 VAC, as a protection feature.

Associated with the ballast controller circuit 170 is a lamp strike overcurrent sensor circuit 160 that senses the back current and, as appropriate, resets the strike sequence to increase performance by providing more accurate control of current. The overcurrent sensor circuit 160 is connected to the voltage VCC bus 134 and also to the Voltage VCC-ballast driver which is supplied to the ballast driver circuit 140. If the overcurrent sensor circuit 160 senses that one or more voltages are outside of predetermined values, it output an overcurrent signal 162 to the control and amplifier circuit 150.

The control and amplifier circuit 150 receives the overcurrent signal 162 from the overcurrent sensor circuit 160, a dimmer bus correction signal 188 from a dimmer time delay switch 186, and PFC current sense signal 158 from the power factor controller circuit 120 and. In response, the control and amplifier circuit 150 outputs a power correction feedback signal 152 to the power factor controller circuit 120, a dimmer delay control signal back to the dimmer time delay switch 186, and a ballast controller on/off signal 154 to a ballast on-off switch 168 which controls voltage VCC-ballast controller 176 supplied to the ballast controller circuit 170.

The dimmer circuit 180 receives dimmer voltage signals 182*a*, 182*b* and outputs information which is used by circuitry, shown generally as a dimmer time delay switch 186, to produce a dimmer bus correction feedback signal 188 to the control and amplifier circuit 150 and a dimmer frequency adjustment signal 174 to the ballast controller circuit 170.

The ballast on/off switch 168 receives the ballast controller on/off signal 154 from the control and amplifier circuit 150. The ballast on/off switch 168 is configured to selectively connects voltage VCC bus 134 to the ballast controller circuit 170 depending on the ballast controller on/off signal 154, as discussed in detail below.

Figure 2:
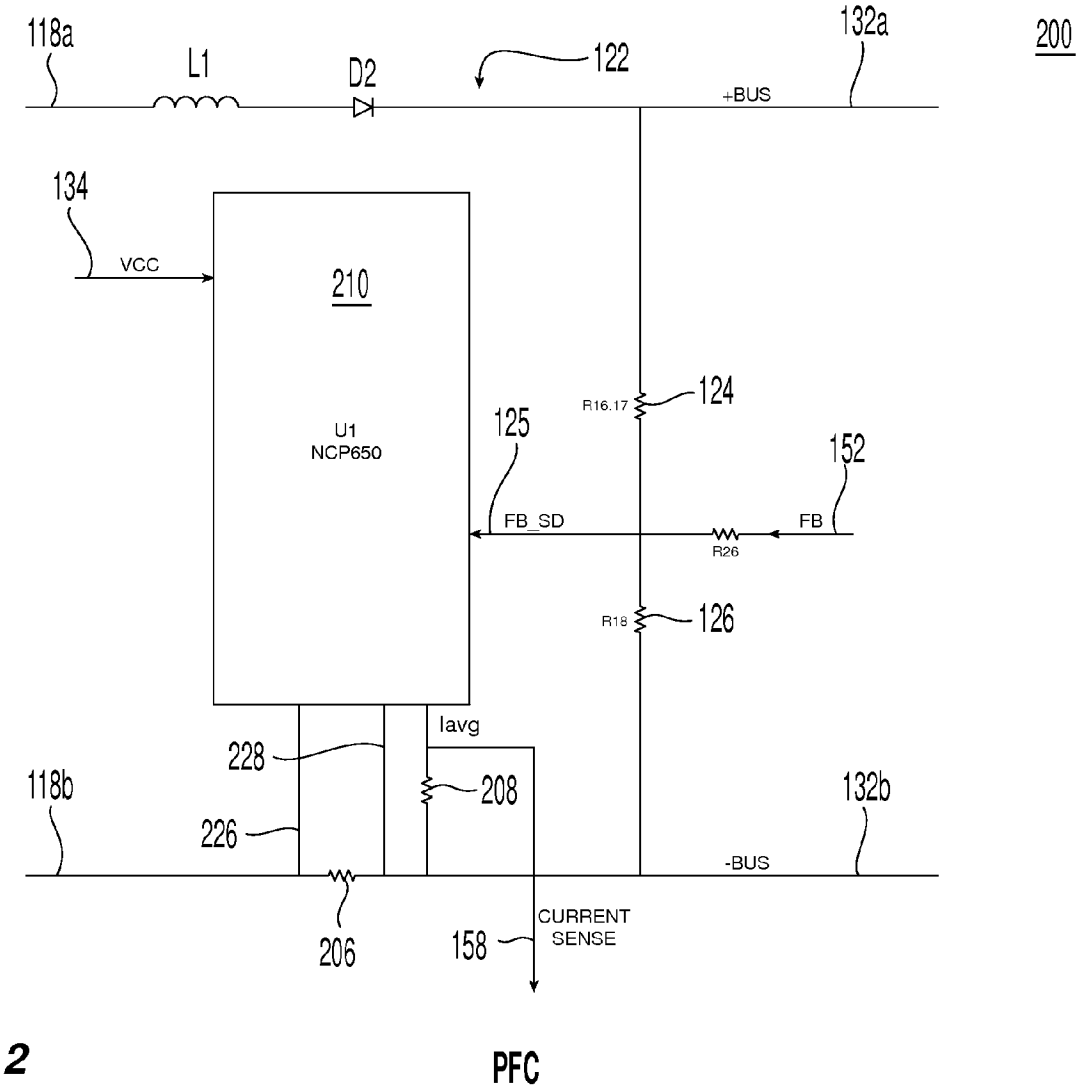
FIG. 2 is a block diagram of one embodiment of power factor correction circuitry for use in the ballast of FIG. 1.

FIG. 2 shows one embodiment 200 of the PFC circuit 120. A PFC integrated circuit chip ("PFC IC") 210 such as the NCP1650, available from ON semiconductor, forms the nucleus of the PFC circuit 120. The peak power handling requirement of the power factor correction circuit 120 is reduced by the bypass rectifier D8 to provide power-up charging of the bus bulk capacitors 128*a*, 128*b*. With the bypass rectifier 420 providing a bypass during startup, the power factor correction circuit 120 does not have to provide the boosted voltage required by the ballast driver circuit 140. The power factor correction circuit 120 is able to operate efficiently over a load range from approximately 50%, e.g., when full dimmed, to full power when it is not required to contend with the full initial startup current.

The high power line 118*a* connects, via a PFC bypass line 122 which includes an inductor L1 and a boost rectifier diode D2, to form the +Main Bus 132*a* for the circuit 100. The low power line 118*b* connects directly to the PFC IC current sense Is pin 226. Meanwhile, the –Main Bus 132*b* is connected to the ground pin GND of the PFC IC.

A PFC current sense resistor 206 is shunted between the Iavg pin and the ground pin GND of the PFC IC. The voltage across the PFC current sense resistor 206 is used by the PFC 210 and contributes to the value the latter's Iavg pin. The PFC current sense resistor 206 has a value selected to be the least resistance able to function in the circuit, allow the least efficiency loss from resistance heating, and be an economical implementation. At its Iavg pin, the PFC IC 210 outputs a PFC current sense signal 158 which is provided on other components, as discussed farther below. A PFC Iavg resistor 208 is connected on one side to the Iavg pin of the PFC IC and on the other side to ground (–Main bus 132*b*). The Iavg pin has a voltage level that varies with respect to an amplifier gain of the PFC IC 210.

Connected between the +Main bus 132*a* and –Main bus 132*s* are a high side first bus divider resistor 124 and a low side second bus divider resistor 126, which together form a voltage divider. A power correction feedback signal 152, whose generation is described further below, is input to a node between the two bus divider resistors 124, 126, which node is connected to the feedback/shutdown (FB_SD) pin 125 of the PFC IC 210.

Figure 3:
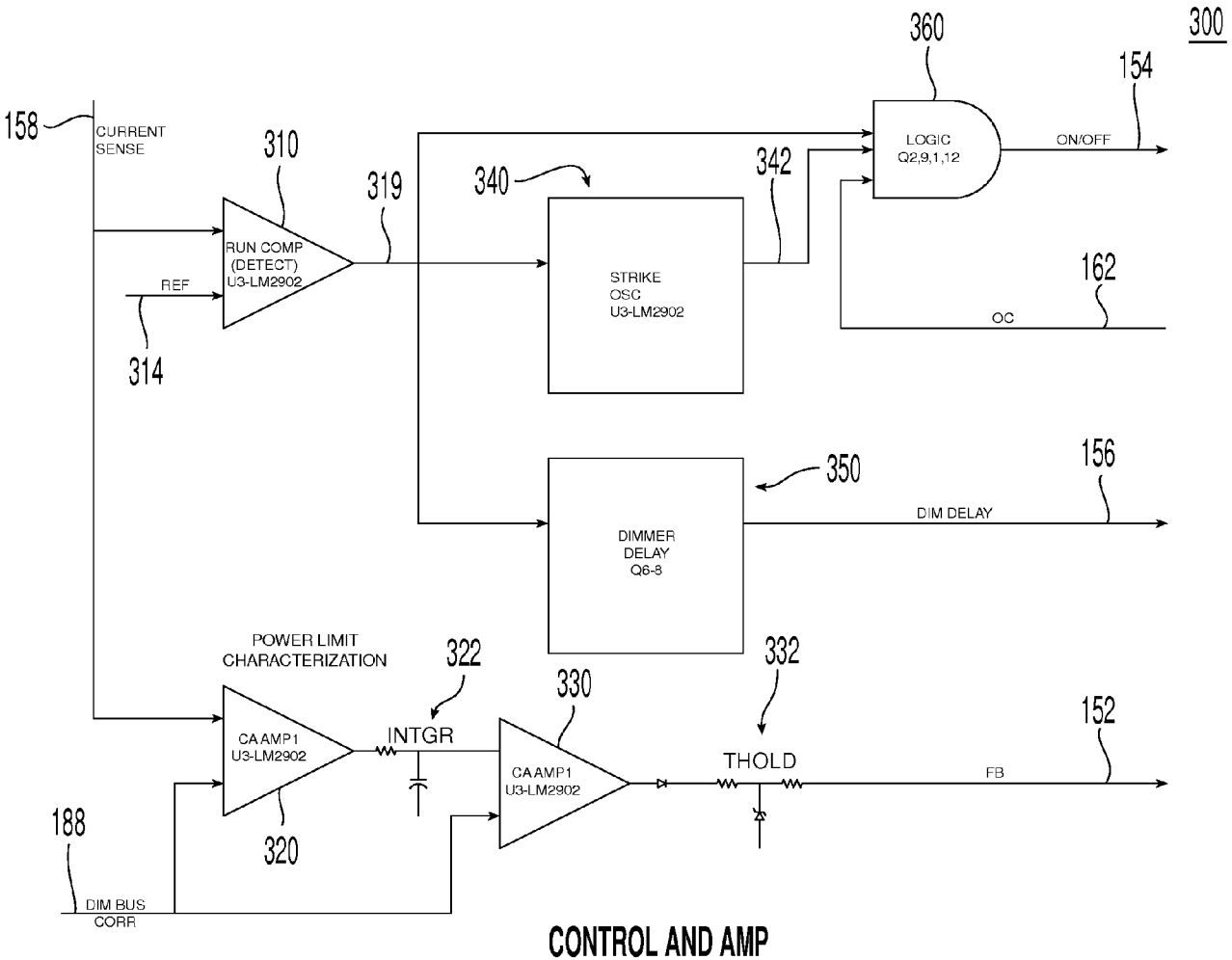
FIG. 3 is a block diagram of one embodiment of controller and amplifier circuitry for use in the ballast of FIG. 1.

FIG. 3 shows one embodiment 300 of the control and amplifier circuit 150. As seen in both FIGS. 1 and 3, the control and amplifier circuit 150 receives the PFC current sense signal 158, a dimmer bus correction feedback signal 188, and an over-current feedback signal 162. The control and amplifier circuit 150 outputs the aforementioned power correction feedback signal 152 which is input to the PFC IC 210, a ballast controller on/off signal 154, and a dimmer delay control signal 156.

The control and amplifier circuit 150 includes a run comparator 310 implemented as an amplifier and configured to determine whether the lamp 602 has been struck and is in a sustained running condition. The run comparator 310 receives a first input from the PFC current sense signal 158 and a second input constituting a run comparator reference signal 314. The run comparator reference signal 314 is a threshold set at a level that is above the warm-up power level and below the run level for the lamp 602. In response to these two inputs, the run comparator 310 outputs a run status signal 319.

The run status signal 319 is applied to dimmer delay timer circuitry 350 which outputs the dimmer delay control signal 156. The run status signal 319 is also applied to a strike oscillator 340 which is implemented using an amplifier and outputs a strike signal 342. The run status signal 319 and the strike signal 342, along with the over-current feedback signal 162, are all applied to ballast enable logic circuitry 360. In response, the ballast enable logic circuitry 360 outputs a ballast on/off signal 154 which is applied to the ballast on/off switch 168 to ultimately control the ballast controller circuitry 170.

The control and amplifier circuit 150 also includes power limit characterization (PLC) circuitry which ultimately outputs the power correction feedback signal 152. The PLC circuitry includes a PLC first amplifier 320, a PLC first amplifier integrator 322, a PLC second amplifier 330 and a PLC second amplifier limiter 332. The PLC first amplifier 320 receives a first input comprising the PFC current sense signal 158 and a second input comprising the dimmer bus correction feedback signal 188.

The output of the PLC first amplifier is then integrated by the PLC first amplifier integrator 322. The integrator circuit 322 has an integration time constant that accounts for the warm-up period of the lamp 602. During warm-up, the lamp 602 is less susceptible to bus voltage variations than during normal operation because of the various circuit impedances and the nature of the lamp 602. The output of the PLC first amplifier integrator 322 is then presented as a first input to the PLC second amplifier 330, while the dimmer bus correction feedback signal 188 is presented as the second input thereto. The output of the PLC second amplifier 330 is then thresholded by the PLC second amplifier limiter 332. The output of the PLC second amplifier limiter 332 then provided as the power correction feedback signal 152.

Figure 4:
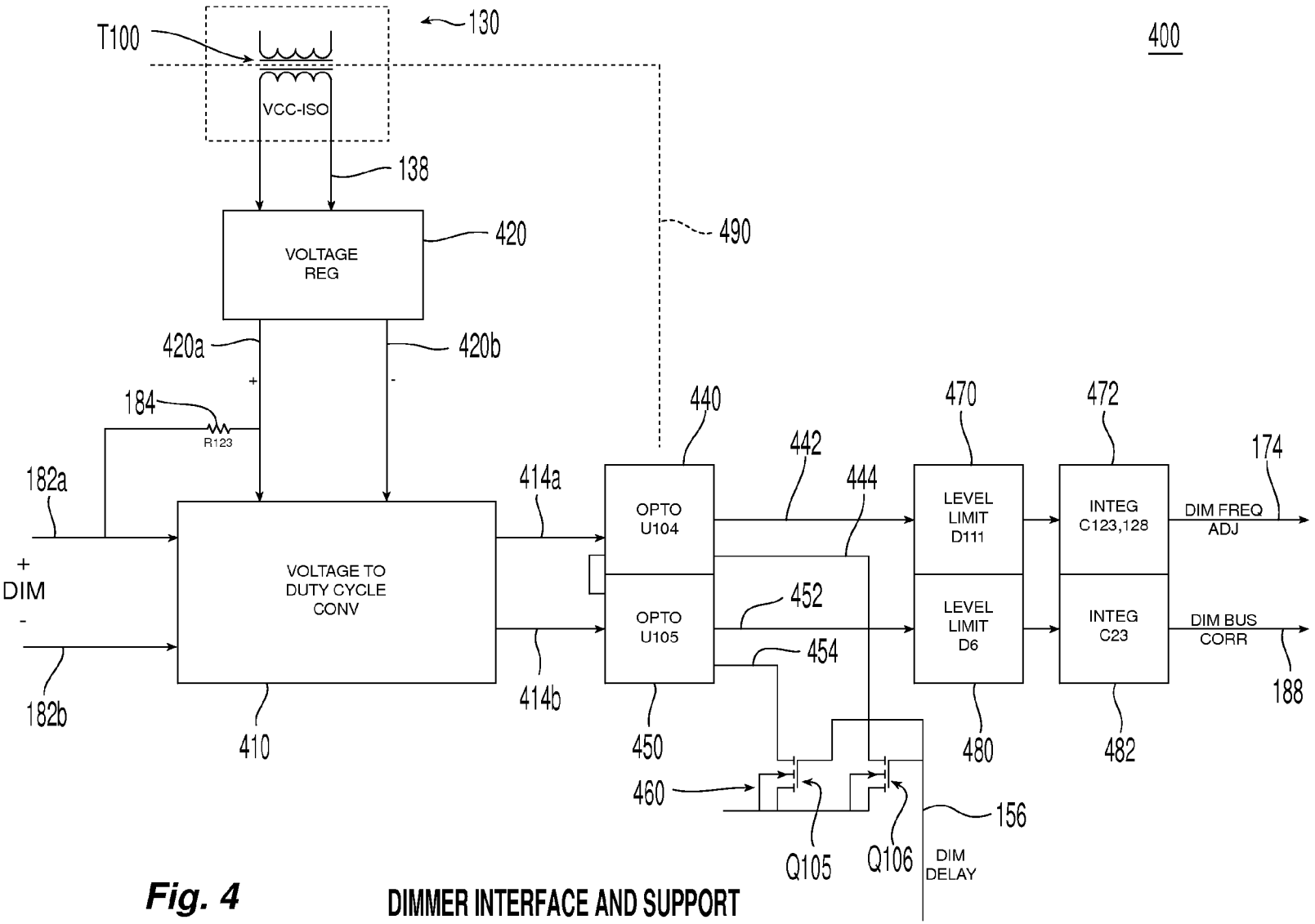
FIG. 4 is a block diagram of one embodiment of dimmer interface and support circuitry for use in the embodiment of FIG. 1.

FIG. 4 shows one embodiment 400 of the combination of the dimmer interface and support circuit 180 in combination with the dimmer time delay switch 186. The combination 400 includes a dimmer converter voltage regulator 420, a voltage-to-duty-cycle converter 410, a pair of opto-isolators 440, 450 and an opto-isolator enable inverter circuit 460 comprising first and second enabling transistors Q105, Q106, respectively. The dimmer interface and support circuitry 180 also includes limit circuitry 470, 480 and integrator circuitry 472, 482, discussed below. Collectively, the first and second enabling transistors Q105, Q106, the limit circuitry 470, 480 and the integrator circuitry 472, 482 functions as the item seen in FIG. 1 as the dimmer time delay switch 186.

The dimmer converter voltage regulator 420 receives the VCC-ISO power signal 138 and outputs high and low dimmer converter VCC signals 420*a*, 420*b* in response thereto. The voltage-to-duty-cycle converter 410 receives high and low (ground) dimmer input signals 182*a*, 182*b* respectively, which generally range from 0-10 volts. A dimmer shunt resistor 184 is coupled between the high dimmer input signal 182*a* and the high converter VCC signal 420*a* to pull up the high dimmer input, when no dimmer signal is present.

The voltage-to-duty-cycle converter 410 is implemented using a pair of Norton-type operational amplifiers provided in a single package, such as an LM2904. A first operational amplifier is operated in "free-run" mode to create a sawtooth waveform from 0-10 volts. The second operational amplifier is configured as a comparator. The output of the first operational amplifier is presented as a first input to the second operational amplifier. The second input to the second operational amplifier is the high input dimmer signal 182*a*. The second operational amplifier thus compares the instantaneous values of the sawtooth waveform output by the first comparator and the high input dimmer signal 182*a*, and outputs dimmer converter output signals 414*a*, 414*b* in response thereto.

The two opto-isolators 440, 450 may be implemented as a single package, such as a 4N35. The internal diodes of the two opto-isolators 440, 450 are connected in series, with the cathode of the first opto-isolator 440 connected to the anode of the second opto-isolator 450. This is done to make sure that the two opto-isolators 440, 450 are driven by the same signal. Thus, as seen in FIG. 4, the dimmer converter output signal 414*a* is presented to the anode of first the first opto-isolator 440 while dimmer converter output signal 414*b* is presented to the cathode of the second opto-isolator 450.

The enabling transistors Q105 and Q106 are both configured to be simultaneously activated by the dimmer delay control signal 156. When simultaneously activated by the dimmer delay control signal 156, the transistors Q105, Q106, via respective base enable leads 454, 444, enable the outputs of the opto-isolators 440, 450, respectively.

The output 442 of the first opto-isolator 440 is fed to a dimmer frequency adjust level limiter 470 whose output is supplied to a dimmer frequency adjust integrator 472. The dimmer frequency adjust integrator 472 integrates the output 442 of the first opto-isolator 440 to produce the dimmer frequency adjustment signal 174.

The output 452 of the second opto-isolator 440 is fed to a dimmer bus correction level limiter 480 whose output is supplied to a dimmer bus correction integrator 482. The dimmer bus correction integrator 482 integrates the output 452 of the second opto-isolator 450 to produce the dimmer bus correction signal 188.

An external circuit isolation barrier 490 is provided to enhance electrical isolation among some of the components of the embodiment 400 of the dimmer interface and support circuitry 18

Figure 5:
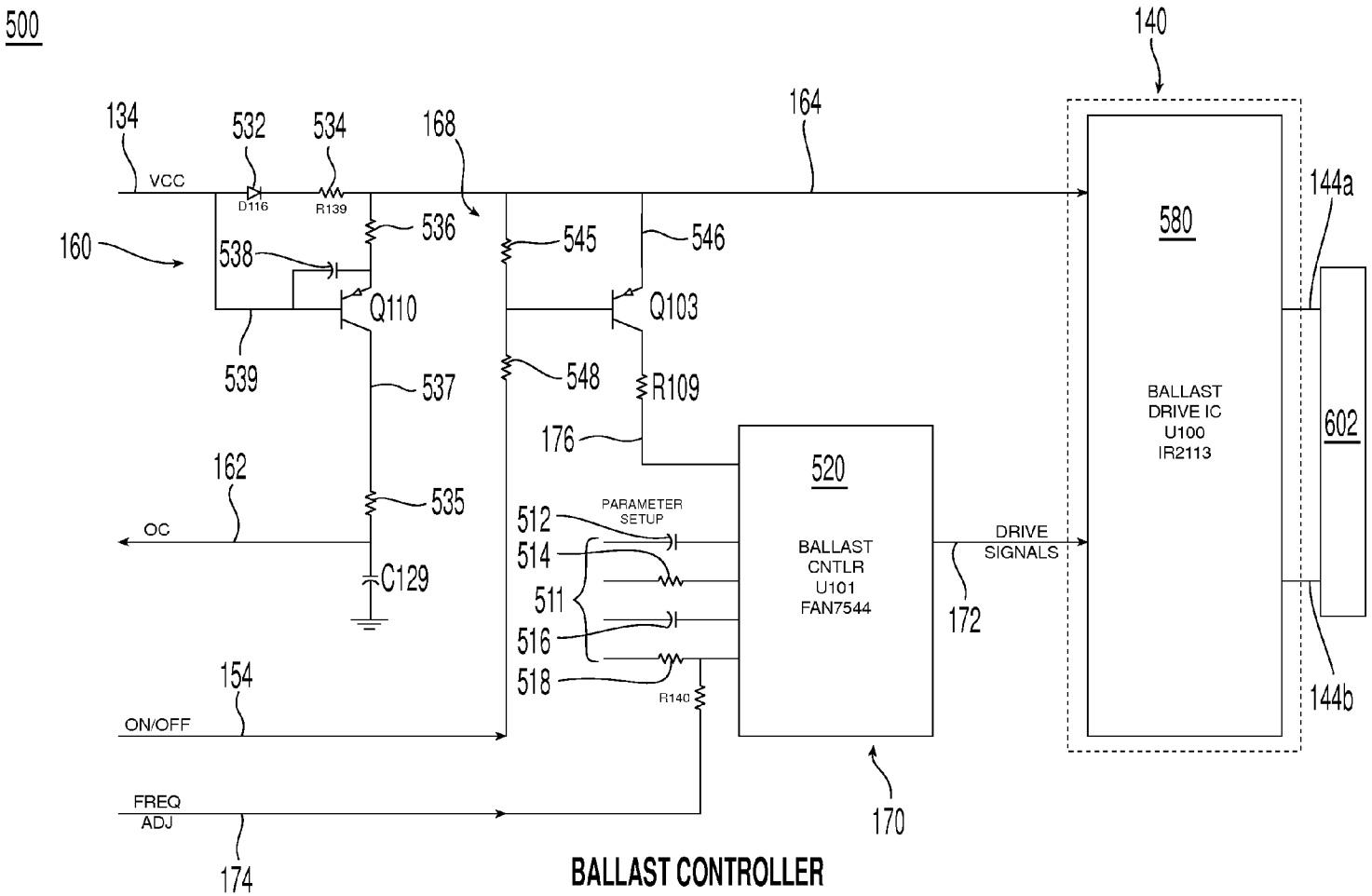
FIG. 5 is a block diagram of one embodiment of ballast controller and ballast driver circuitry in the embodiment of FIG. 1.

FIG. 5 shows one embodiment 500 of the combined circuitry of the overcurrent sensor circuit 160, the ballast driver circuit 140, the ballast controller circuit 170 and a ballast on/off switch circuit 168.

The ballast controller circuit 170 comprises a ballast controller integrated circuit 520 (ballast controller IC 520), which may be implemented as the FAN7544, which is known to those skilled in the art.

One input to the ballast controller IC 520 is the dimmer frequency adjustment signal 174 created by the dimmer interface circuit. Dimmer frequency adjustment signal 174 is connected to the RT pin of the ballast controller IC 520. The parameter pins, shown generally as 511, are connected to set up the ballast IC 520. These parameter pins may be connected to a ballast controller setup sweep TC capacitor 512, a ballast controller setup sweep TC resistor 514 (pin RPH), a ballast controller setup run frequency capacitor 516, and a ballast controller setup run frequency resistor 518 (pin RT).

A second input to the ballast controller IC 520 is the supply voltage VCC, which is selectively provided to the VCC pin of the ballast controller IC 520 to provide voltage VCC-ballast controller 176. Voltage VCC-ballast controller 176 is controlled by the ballast on/off switch 168. Ballast on/off switch 168 is implemented as a ballast controller switching transistor Q103. The emitter lead 546 of transistor Q103 is connected to the voltage VCC-ballast driver 164. Voltage VCC-ballast controller 176 is connected to Q103's collector lead via collector resistor R109. On its base side, Q103 is connected to voltage VCC-ballast driver 164 via the high-side ballast controller Vcc switch divider resistor 545. The ballast controller on/off signal 154 is input to the Q103 base via the low-side ballast controller Vcc switch divider resistor 548. Thus, the on/off ballast control signal 154 output by the controller and amplifier circuit 150 can control the operation of the ballast controller IC 520, by disconnecting VCC to the ballast controller.

The overcurrent sensor circuit 160 includes an overcurrent sense transistor Q110 has its base connected to the VCC bus 134 via Vcc base line 539. The emitter of overcurrent sense transistor Q110 is connected via sense current limit resistor 536 to the voltage VCC-ballast driver 164 while a sense compensation capacitor 538 is connected between the emitter and the Vcc base line 539. Interposed between the VCC bus 134 and the voltage VCC-ballast driver 164 are a sense diode 532 connected in series with sense resistor 534. The collector of the transistor Q110 is connected to ground via an integration circuit comprising a sense integrator resistor 535 connected in series with a sense integrator capacitor C129. The capacitor signal 537, which is derived from the impact of the voltages at VCC buses 134, 164, is integrated by sense integrator resistor 535 and sense integrator capacitor C129. The voltage level across the sense integrator capacitor C129 is output as the overcurrent signal 162, which is supplied to the control and amplifier circuit 150 whose embodiment 300 is described above with reference to FIG. 3.

The overcurrent sensor circuit 160 resets the strike sequence when the voltage of the bus filter capacitors 128*a*, 128*b* falls below a threshold value. The bus filter capacitors 128*a*, 128*b* are connected to the bus supplying power to the driver circuit 140 for the lamp 602. During lamp strike, the bus filter capacitors 128*a*, 128*b* provide the additional power required to start the lamp 602. If the lamp 602 fails to start, the bus filter capacitors 128*a*, 128*b* are depleted, with a corresponding drop in bus voltage below a threshold value. The threshold value of the voltage of the bus filter capacitors/bus is a voltage level that indicates that the lamp strike was unsuccessful. Another feature of the overcurrent sensor circuit 160 is circuit protection in case of power supply and/or bus filter capacitors failures that result in loss of normal voltage level.

The ballast controller IC 520 output drive signals 172 are sent to the ballast driver IC 580 belonging to the ballast driver circuit 140. As discussed below with reference to FIG. 6, the ballast driver circuit 140 receives these drive signals 172 to operate the lamp 602 via lamp power leads 144*a*, 144*b*.

Figure 6:
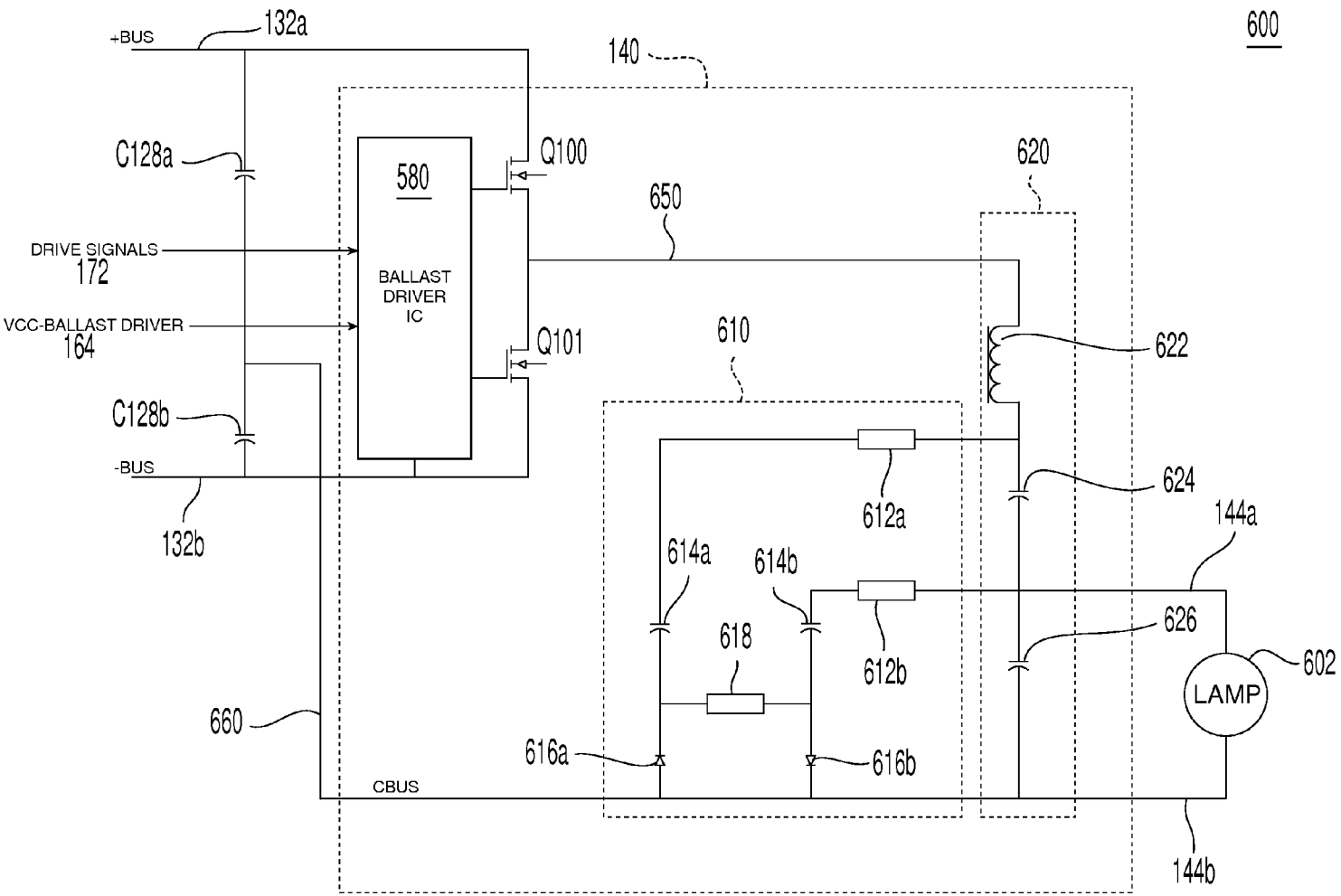
FIG. 6 is a block diagram of one embodiment of ballast driver and voltage limiter circuitry for use in the embodiment of FIG. 1.
Figure 7:
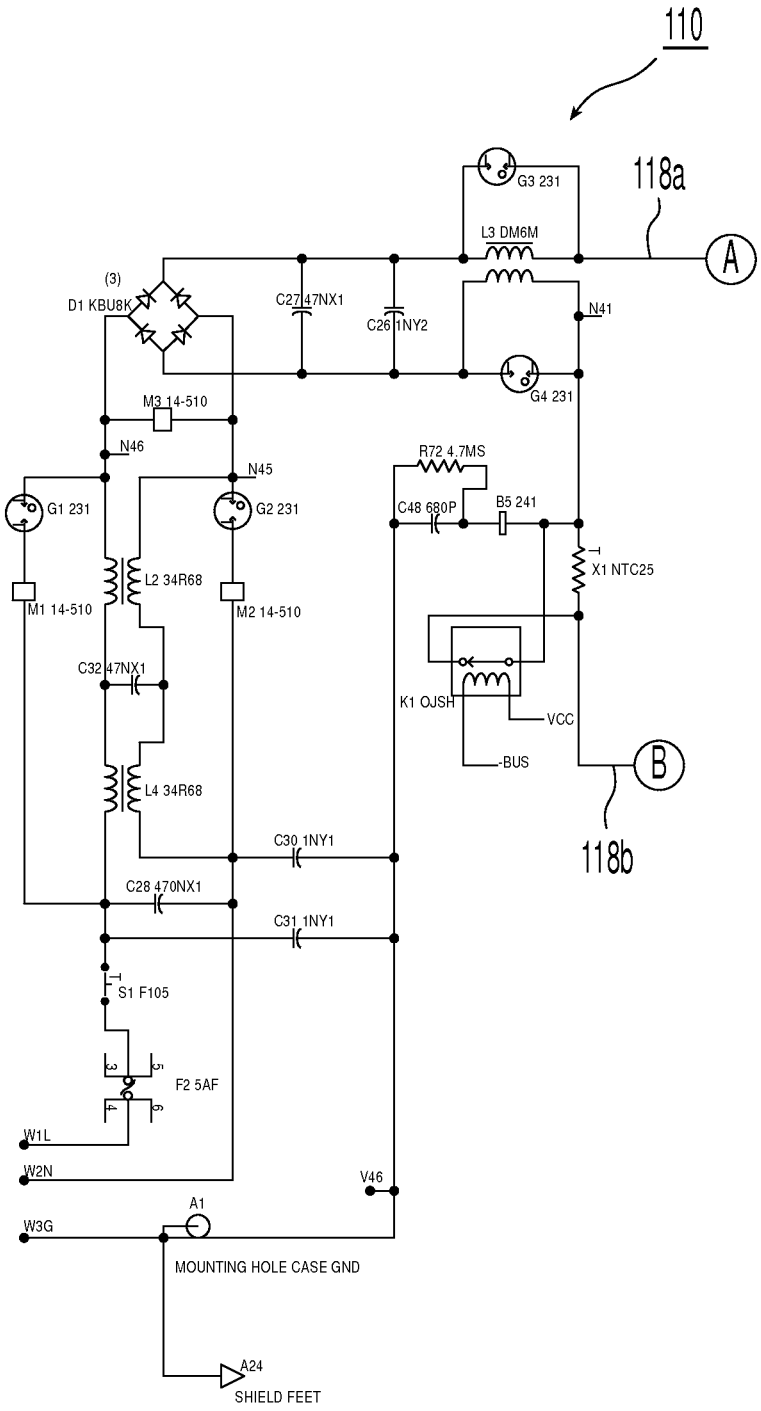
FIG. 7 is one embodiment of a schematic for an electronic ballast of FIG. 1 showing EMI filtering and rectifier circuitry.
Figure 8:
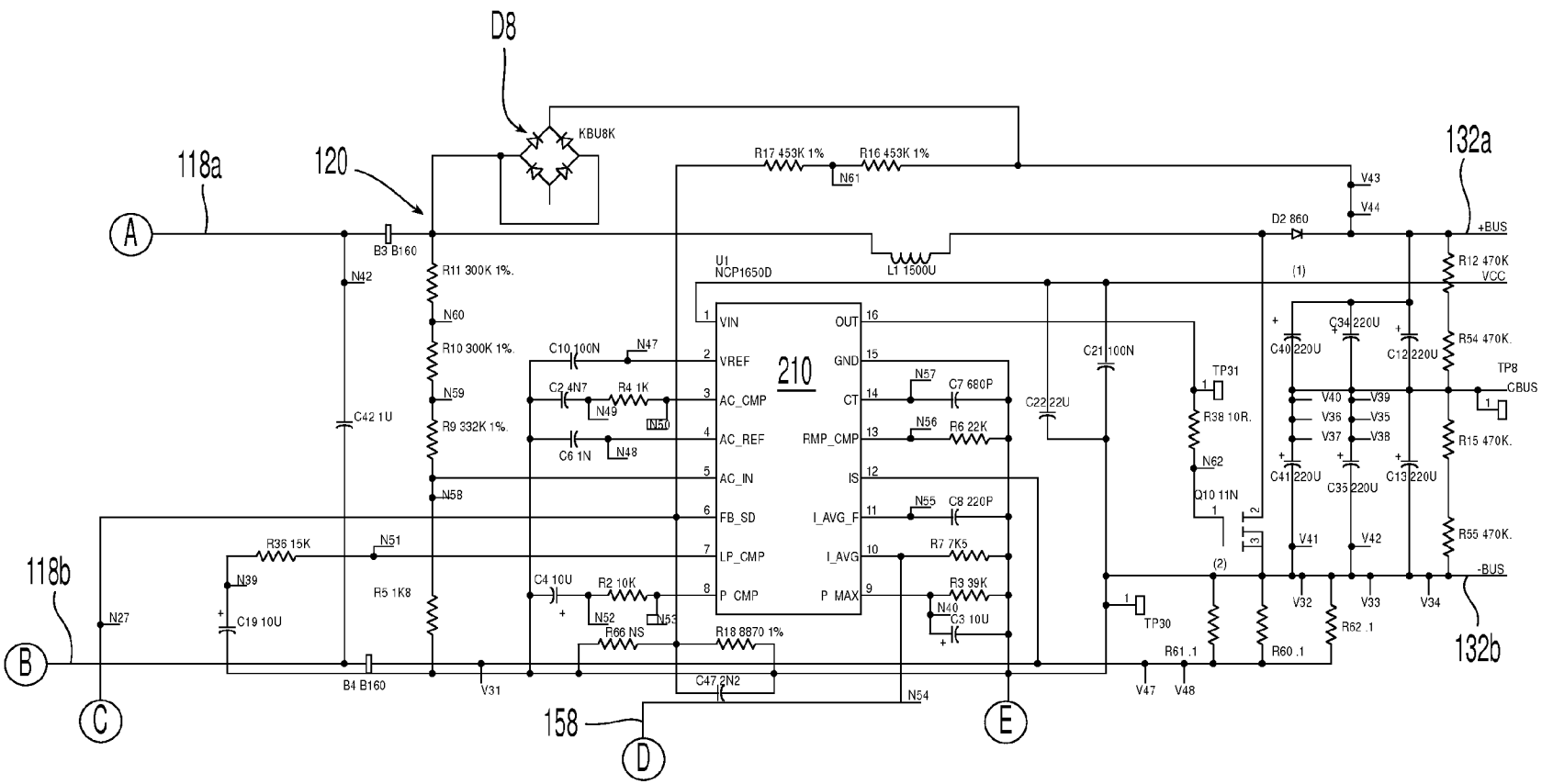
FIG. 8 is one embodiment of a schematic for an electronic ballast of FIG. 1 showing power factor correction circuitry.
Figure 9:
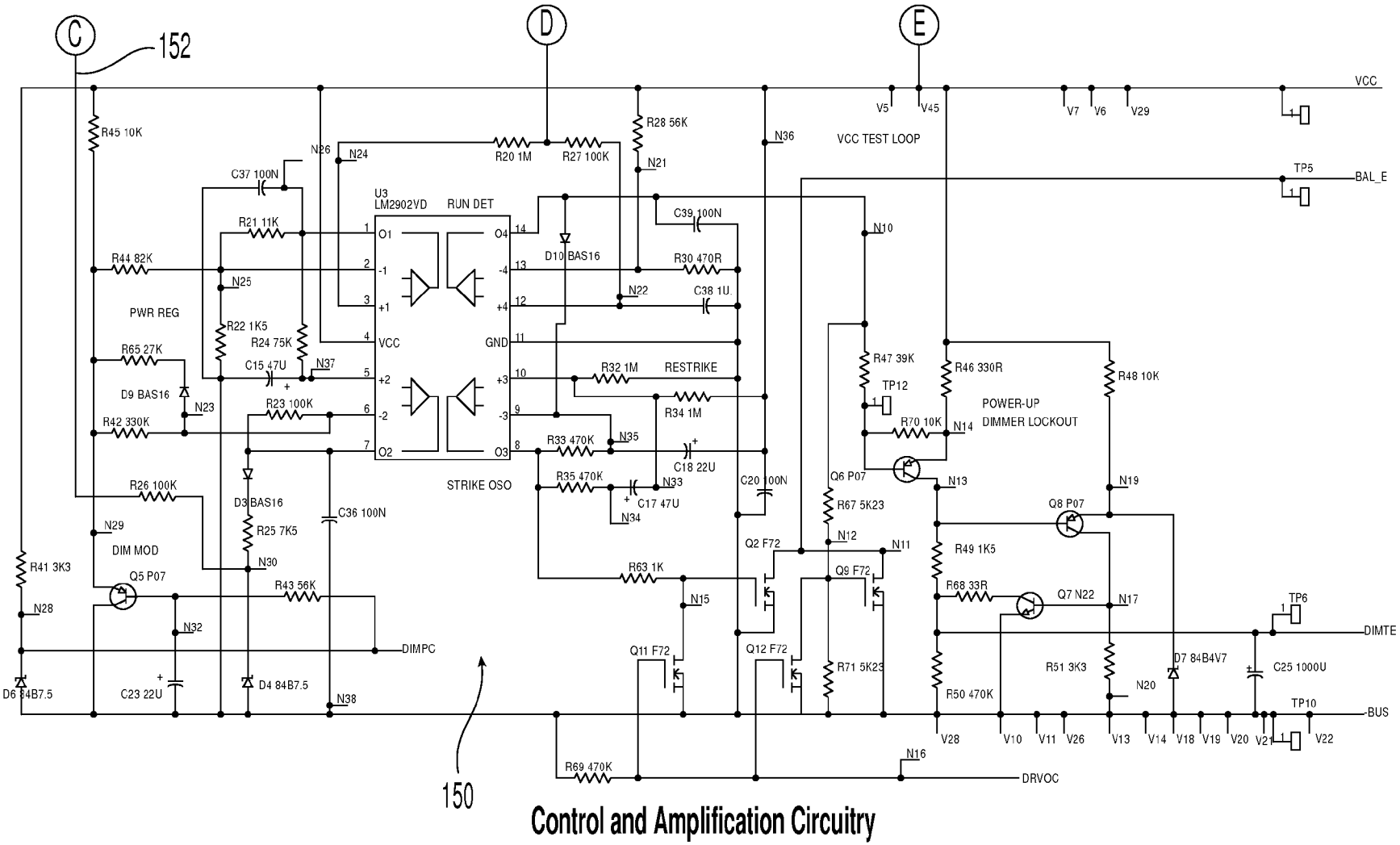
FIG. 9 is one embodiment of a schematic for an electronic ballast of FIG. 1 showing control and amplification circuitry.
Figure 10:
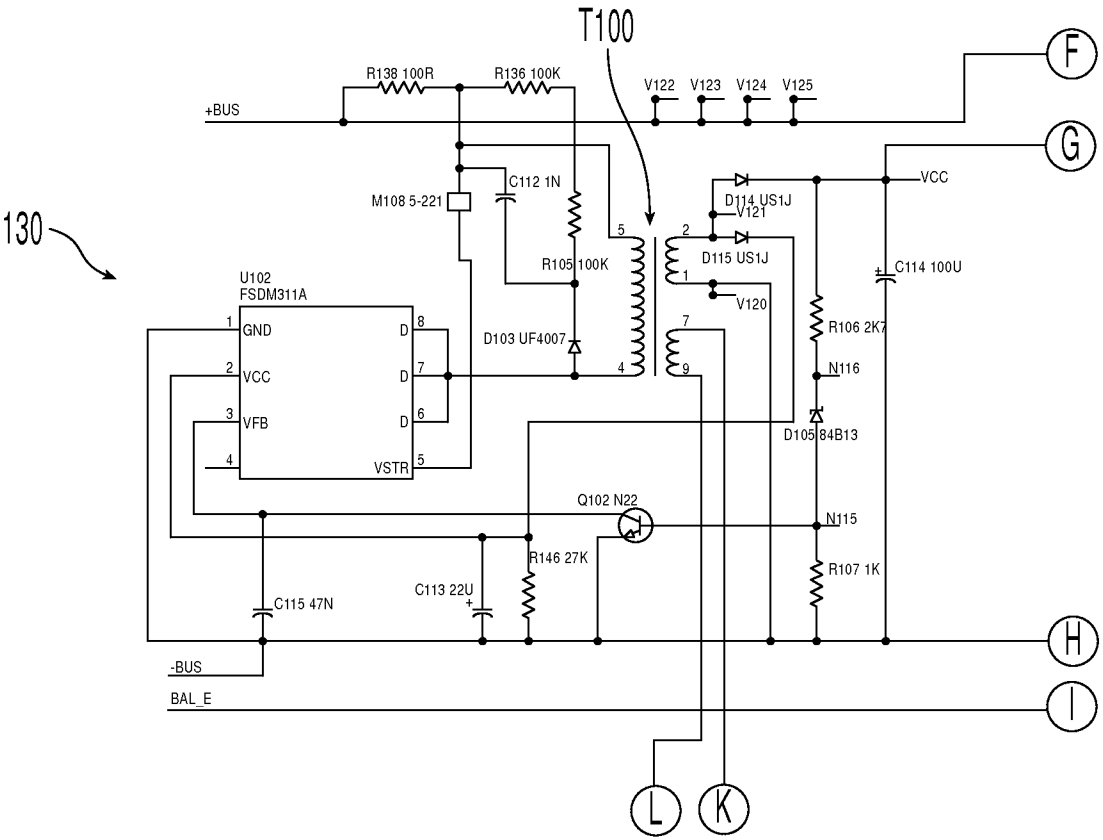
FIG. 10 is one embodiment of a schematic for an electronic ballast of FIG. 1 showing voltage regulator circuitry.
Figure 11:
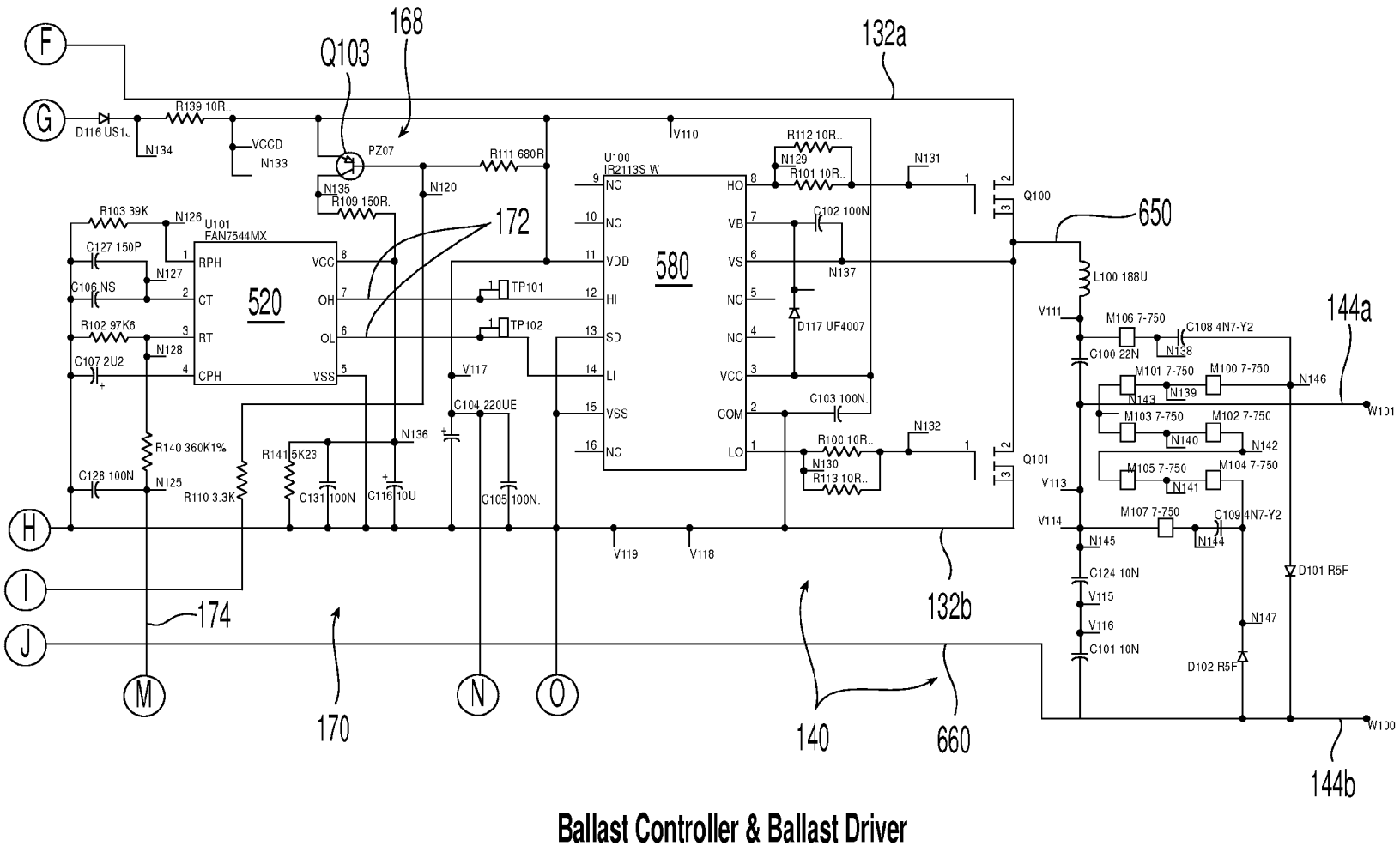
FIG. 11 is one embodiment of a schematic for an electronic ballast of FIG. 1 showing ballast controller and ballast driver circuitry.
Figure 12:
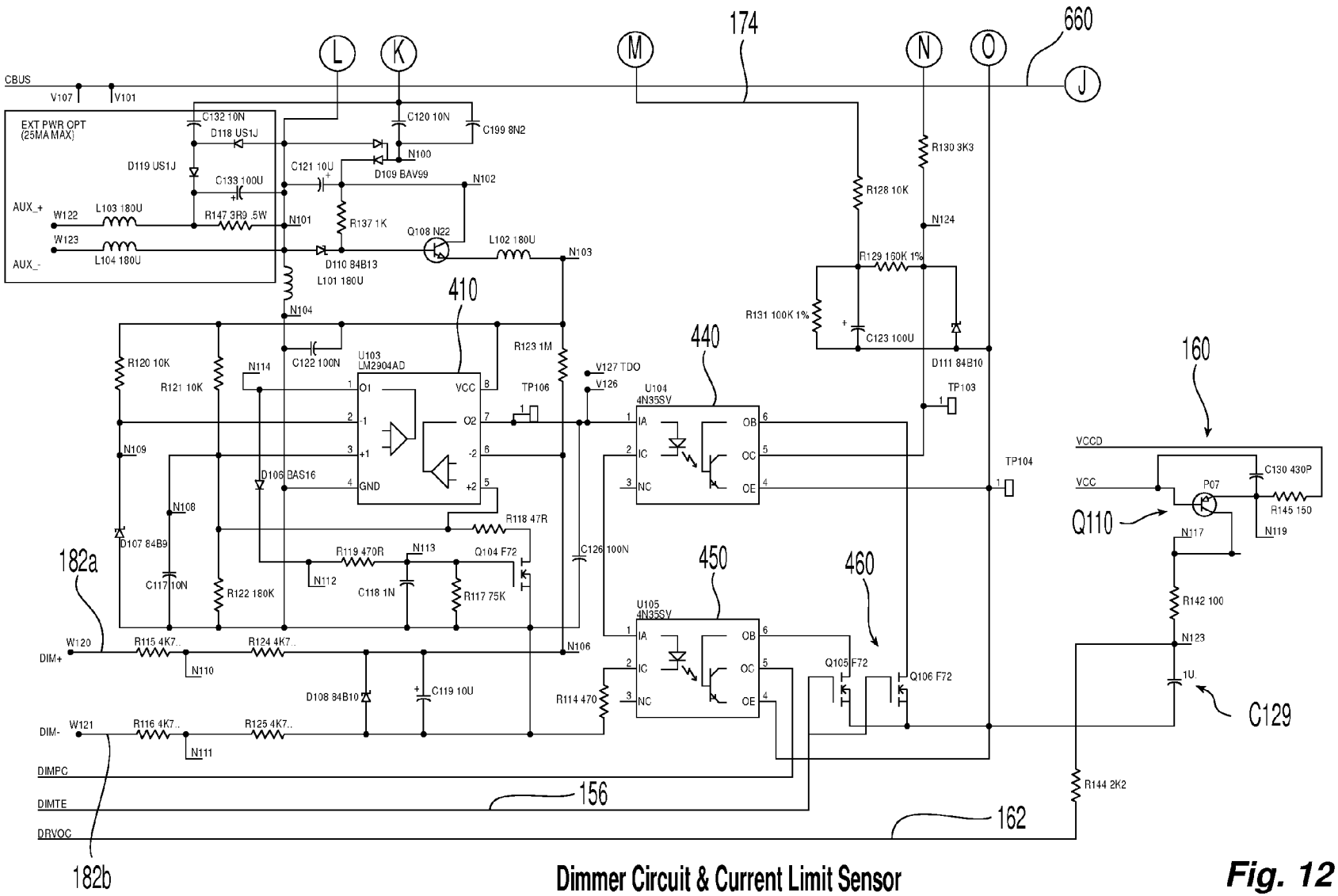
FIG. 12 is one embodiment of a schematic for an electronic ballast of FIG. 1 showing the dimmer circuit and current limiter circuitry.

FIG. 6 illustrates circuitry 600 including the ballast driver and voltage limiter circuit 140 for driving the lamp 602. The ballast driver integrated circuit 580 is provided with power from voltage VCC-ballast driver 164 and is also connected to the −Main Bus 132*b*. In addition, as discussed above, the ballast driver integrated circuit receives driver signals 172 from the ballast controller circuit, and more particularly from the ballast controller chip 520. The ballast driver integrated circuit 580 has outputs connected to the gates of power transistors Q100 and Q101. Transistor Q100 is connected to power at +Main Bus 132*a* while transistor Q101 is connected to power at −Main Bus 132*b*. The outputs of power transistors Q100 and Q101 are tied together to form a resonant circuit driver signal 650. Meanwhile, a resonant circuit return signal (Cbus) 660 is formed at a node between bus filter capacitors 128*a*, 1286 (see FIG. 1).

As seen in FIG. 6, the ballast driver and voltage limiter circuit 140 includes a resonant circuit 620 and a strike voltage limiter circuit 610. During lamp strike, a high voltage is developed across the lamp 602. It is desirable to limit the lamp strike voltage to ensure lamp longevity.

The resonant circuit 620 is configured as an LC circuit interposed between the ballast driver 580 and the lamp 602. The resonant circuit 620 has a resonant frequency equal to the frequency of the ballast driver 580. By matching the frequency of the ballast driver 580 to the resonant frequency of the resonant circuit 602, maximum power is transferred to the lamp 602. The resonant circuit 620 comprises an LC circuit inductor 622, an LC circuit run capacitor 624 and an LC circuit strike capacitor 626. The LC circuit strike capacitor 626 is in electrical parallel with the lamp 602.

The strike voltage limiter circuit 610 has a warmup/run voltage standoff high side varistor 612*a* ("first varistor 612*a*"), a strike voltage charge high side capacitor 614*a* ("first capacitor 614*a*"), a strike voltage limiter varistor 618 ("bridging varistor 618"), a strike voltage charge low side capacitor 612*a* ("second capacitor 612*a*"), and a warmup/run voltage standoff low side varistor 612*b* ("second varistor 612*b*"), connected across the LC circuit run capacitor 624.

As is known to those skilled in the art, a varistor has high resistance below a threshold voltage. When the voltage across the varistor exceeds the threshold, the varistor becomes conductive. To accommodate high voltages, multiple varistors may be connected in series. In some embodiments of the present invention, metal oxide varistors (MOV) may be used.

The connection of the bridging varistor 906 to each capacitor 614*a*, 614*b* also provides a connection for a corresponding diode 616*a*, 616*b*. The diodes 616*a*, 616*b* allow the capacitors 614*a*, 614*b* to be charged to a dc potential. Varistors 612*a*, 612*b* provide a voltage threshold sufficient to prevent the strike voltage limiter 620 from interfering with normal lamp running drive levels. When the cumulative potential across the capacitors 614*a*, 614*b* reaches the voltage limit of the bridging varistor 618, the bridging varistor 618 conducts, thereby limiting the lamp strike voltage to the voltage equal to the cumulative voltage ratings of the first and second varistors 612*a*, 612*b* and the bridging varistor 618. The peak of the voltage waveform overcomes the bridging varistor 618 to provide current flow across LC circuit run capacitor 624. This current prevents the continuing increase in resonant voltage development without increasing the drive current. Thus, it indirectly limits the driver demand in current and sizing for the application and allows the use of more economical driver switch devices that have typically lesser nC for faster switching and higher efficiency.

When lamp strike occurs, the lamp strike voltage is reached before the over-current signal is generated, with the delay being a result of the hold up capacitor 128*a*, 128*b* depletion. On the other side, with the strike being created by the frequency sweep of drive through the L/C resonant frequency, a finite dwell time at peak strike voltage is created by the L/C 'Q' and rate of the sweep. The hold up capacitor on the main bus is significantly of less charge than what would be required by the full sweep, and, therefore, the over-current is the source of the strike termination. This also prevents what is known as a false start of the lamp 602. For example, high intensity discharge (HID) lamps, under extreme uncontrolled conditions, have the capability of continuing the initial starting arc. The hold up depletion method of control prevents the arc from continuing.

After the lamp 602 strikes, the resonant LC circuit strike capacitor 626 is shunted by the relatively low effective impedance of the lamp 602. As a result, using one embodiment as an example, the 180 KHz resonant frequency of the resonant circuit 610 is changed to 75 KHz and becomes predominantly inductive because the drive frequency is on the upper slope of the curve. As the arc in the lamp 602 turns to a plasma, the maximum required lamp current is reduced from 4 A to 2.6 A at typical nominal run values. Given the drive impedance, the typical lamp 602 converts within a few minutes. Accordingly, adjustments in power and/or brightness are made at a slow rate that is barely, if at all, perceptible. Further, to avoid stability issues, the rate of adjustment is less than the PFC power gain response characteristic. For example, the PFC dynamic power gain characteristic is set at 5 Hz rate to support a typical strike and lamp run.

It can be seen from the foregoing that the voltage limiter 610 limits the strike voltage applied by the ballast circuit 140 when the lamp 602 starts. The voltage limiter 610 uses varistors to switch in circuit components, e.g., capacitors, that shifts the resonant circuit parameters based on voltage levels. When a certain voltage is reached, the varistors conduct and completes a circuit connected to the resonant circuit 620. The voltage limiter 610 changes the resonant frequency of the resonant circuit 620, which causes the voltage to the lamp 602 to be clamped at a maximum value.

As seen in FIG. 6, the ballast driver circuit 140 including the resonant circuit 610 and voltage limiter circuit 6100 is devoid of a resistor configured for detecting current conditions in the circuit 140, unlike in prior art ballast circuits. The absence of such a resistor helps mitigate power consumption and generation of heat in the ballast circuit 100.

While the present invention has been described with reference to one or more specific embodiments, the description is intended to be illustrative as a whole and is not to be construed as limiting the invention to the embodiments shown. It is appreciated that various modifications may occur to those skilled in the art that, while not specifically shown herein, are nevertheless within the scope of the invention.

LIST OF REFERENCE NUMERALS

100—Ballast Circuit
110—EMI and Filter Bridge Circuit
112*a*—inlet, N1
112*b*—inlet, N2
114—inlet, Safety Ground
116—PFC input capacitor
118*a*—rectified sinewave (+)
118*b*—rectified sinewave (−)
120—Power Factor Controller
122—bypass line
124—bus divider, high side
125—feedback/shutdown pin on PFC IC
126—bus divider, low side
128*a*—bus filter capacitor high
128*b*—bus filter capacitor low
130—Voltage Regulator Circuit
132*a*—+Main bus
132*b*—−Main bus
134—Vcc bus
138—Vcc-Iso
140—Ballast Driver Circuit
144*a*—Lamp Power Lead 1
144*b*—Lamp Power Lead 2
150—Control and Amplifier Circuit
152—power correction feedback signal
154—ballast controller on/off signal
156—Dimmer Delay Control Signal
158—PFC Current Sense signal (from Iavg pin of PFC IC)
160—overcurrent sensor circuit
162—over-current feedback signal
164—Voltage VCC-ballast driver
168—ballast on-off switch
170—Ballast Controller Circuit
172—Drive Signals
174—dimmer frequency adjustment signal
176—Voltage VCC-ballast controller
180—Dimmer Circuit
182*a*—Dim input (+)
182*b*—Dim input (−)
184—dimmer Shunt Resistor
186—dimmer time delay switch
188—dimmer bus correction feedback signal
200—Power Factor Controller Circuit
206—PFC current sense resistor
208—PFC Iavg resistor
210 NCP1650 (ON Semiconductor)
300—Controller and Amplifier Circuit
310—Run comparator
314—Run comparator reference
319—Run status signal
320—PLC Amp 1
322—PLC Amp 1 Integrator
330—PLC Amp 2
332—PLC Amp 2 limiter
340—Strike Oscillator
342—Strike signal
350—Dim Delay Timer
360—Ballast Enable logic
400—Dimmer Interface and Support Circuit
410—Voltage to Duty Cycle converter
414*a,b*—Dim converter out
420—Dim converter Vcc regulator
420*a*—Dim converter Vcc+
420*b*—Dim converter Vcc−
430—T100 transformer
440—Opto isolator U104
442—Opto isolator U104 out
444—Opto isolator U104 enable
450—Opto isolator U105

452—Opto isolator U105 out
454—Opto isolator U105 enable
460—Opto isolator enable inverters
Q105—first transistor enable inverter
Q106—second transistor enable inverter
470—Dimmer frequency adjust level limiter
472—Dimmer frequency adjust integrator
480—Dimmer bus correction level limiter
482—Dimmer bus correction integrator
490—isolation barrier
500—Ballast Controller and Driver Circuit
511—ballast controller parameter pins
512—ballast controller setup sweep TC capacitor
514—ballast controller setup sweep TC resistor
516—ballast controller setup run frequency capacitor
518—ballast controller setup run frequency resistor A
520—ballast control IC
Q110—OC sense transistor
532—OC sense diode D116
C129—OC sense integrator capacitor
534—OC sense resistor R139
535—OC sense integrator resistor
536—OC sense current limit resistor
537—OC sense signal
538—OC sense compensation capacitor
539—Vcc line into sense transistor
Q103—Ballast controller Vcc switch transistor
545—high-side ballast controller Vcc switch divider resistor
546—Emitter lead of ballast controller transistor switch
R109—Collector resistor of ballast controller transistor switch
548—low-side ballast controller Vcc switch divider resistor
580—Ballast Driver IC IR2113
600—Ballast Driver Circuit
602—Lamp
610—strike voltage limiter
612*a*—warmup/run voltage standoff high side
612*b*—warmup/run voltage standoff low side
614*a*—strike voltage charge capacitor high side
614*b*—strike voltage charge capacitor low side
616*a*—strike rectifier diode high side
616*b*—strike rectifier diode low side
618—strike voltage limiter MOV
620—resonant LC circuit
622—resonant LC circuit inductor
624—resonant LC circuit run capacitor
626—resonant LC circuit strike capacitor
650—Resonant Circuit Driver Signal
660—Resonant Circuit Return Signal (Cbus)

What is claimed is:

1. An electronic ballast circuit for limiting lamp strike voltage, comprising:

a ballast driver circuit (140) comprising:

a resonant circuit (620) having a first resonant frequency and configured to drive a lamp (602); and a voltage limiter circuit (610) connected to said resonant circuit (620); wherein:

the resonant circuit (620) comprises a first inductor (622), a run capacitor (624) and a strike capacitor (626) connected together in series, with the lamp (602) connected across the strike capacitor (626); and the voltage limiter circuit (610) is connected across the run capacitor (624).

2. The electronic ballast circuit for limiting lamp strike voltage according to claim 1, wherein said first resonant frequency changes to a second resonant frequency when a lamp voltage exceeds a threshold voltage, whereby said lamp voltage is clamped to said threshold voltage.

3. The electronic ballast circuit according to claim 1, wherein the voltage limiter circuit (610) comprises:

a first varistor (612*a*), a strike voltage charge high side capacitor (614*a*) and a first diode (616*a*) connected in series between a high side of the run capacitor (624) and a common voltage (Cbus);

a second varistor (612*b*), a strike voltage charge low side capacitor (614*b*) and a second diode (616*b*) connected in series between a low side of the run capacitor (624) and said common voltage (Cbus);

wherein the first diode (616*a*) is arranged to conduct in a first direction and the second diode (616*b*) is arranged to conduct in a direction opposite to the first direction.

4. The electronic ballast circuit according to claim 3, wherein the voltage limiter circuit (610) further comprises:

a third varistor (618) bridging a first point located between the strike voltage charge high side capacitor (614*a*) and the first diode (616*a*) and a second point located between the strike voltage charge low side capacitor (614*b*) and the second diode (616*b*).

5. The electronic ballast circuit according to claim 3, wherein:

the common voltage (Cbus) is derived from a voltage divider formed by first and second capacitors (128*a*, 128*b*) connected across a pair of bus lines (132*a*, 132*b*).

6. The electronic ballast circuit according to claim 3, wherein:

the ballast driver circuit (140) devoid of a resistor configured for detecting current conditions therein to mitigate power consumption and generation of heat.

7. The electronic ballast circuit according to claim 1, further comprising:

a ballast controller circuit configured to output at least one drive signal to said ballast driver circuit;

a power factor correction circuit outputting a current sense signal reflective of a voltage;

a control and amplifier circuit configured to receive said current sense signal, provide a power correction feedback signal to the power factor correction circuit, and provide one or more output signals to control the ballast controller circuit; and an overcurrent sensor circuit configured to output a signal to the control and amplifier circuit to thereby indirectly control the ballast controller circuit via the control and amplifier circuit.

8. The electronic ballast circuit according to claim 1, further comprising:

a power supply circuit (110);

a power factor controller circuit (120) connected to said power supply (110), said power factor controller circuit (120) comprising a PFC integrated chip (210) and a voltage divider.

9. The electronic ballast circuit for limiting lamp strike voltage according to claim 8, wherein said voltage divider comprises a first bus divider resistor (124) and a second bus divider resistor (126).

10. The electronic ballast circuit for limiting lamp strike voltage according to claim 9, further comprising a node disposed between said first bus divider resistor (124) and said second bus divider resistor (126).

11. The electronic ballast circuit for limiting lamp strike voltage according to claim 10, wherein said first bus divider resistor (124) is disposed between a first main bus (+Main bus 132*a*) and said node.

12. The electronic ballast circuit for limiting lamp strike voltage according to claim 10, wherein said second bus divider resistor (124) is disposed between a second main bus (−Main bus 132*b*) and said node.

13. The electronic ballast circuit according to claim 1, further comprising:

a run comparator (310);

a strike oscillator (340) connected to said run comparator (310); and ballast enable logic circuitry (360) connected to said run comparator (310) and said strike oscillator (340).

14. The electronic ballast circuit for limiting lamp strike voltage of claim 13, further comprising a dimmer delay timer circuitry (350) connected to said run comparator (310).

15. The electronic ballast circuit for limiting lamp strike voltage of claim 13, further comprising:

a power limit characterization (PLC) circuitry (317), said PLC circuitry (317) comprising: a PLC first amplifier 320, a PLC first amplifier integrator 322, a PLC second amplifier 330, and a PLC second amplifier limiter 332.

16. The electronic ballast circuit according to claim 1, further comprising:

a dimmer converter voltage regulator (420);

a voltage-to-duty-cycle converter (410) connected to said dimmer converter voltage regulator (420);

a first opto-isolator (440) connected to said voltage-to-duty-cycle converter (410); and a second opto-isolator (450) connected to said voltage-to-duty-cycle converter (410).

17. The electronic ballast circuit for limiting lamp strike voltage according to claim 16, further comprising a dimmer shunt resistor (184) disposed between said dimmer converter voltage regulator (420) and said voltage-to-duty-cycle converter (410).

18. The electronic ballast circuit for limiting lamp strike voltage according to claim 16, wherein said first opto-isolator (440) and said second opto-isolator (450) are connected in series.

19. The electronic ballast circuit for limiting lamp strike voltage according to claim 18, wherein a cathode of said first opto-isolator (440) is connected to an anode of said second opto-isolator (450).

20. The electronic ballast circuit for limiting lamp strike voltage according to claim 16, further comprising:

an opto-isolator enable inverter circuit (460) comprising a first enabling transistor (Q105) and a second enabling transistor (Q106), wherein said first enabling transistor (Q105) is connected to said first opto-isolator (440) and said second enabling transistor (Q106) is connected to said second opto-isolator (450).

21. The electronic ballast circuit for limiting lamp strike voltage according to claim 20, further comprising:

a dimmer frequency adjust level limiter (470) disposed between said first opto-isolator (440) and a dimmer frequency adjust integrator (472); and a dimmer bus correction level limiter (480) disposed between said second opto-isolator (440) and a dimmer bus correction integrator (482).

22. The electronic ballast circuit according to claim 1, further comprising:

an overcurrent sensor circuit (160);

a ballast controller integrated circuit (IC) (520) connected to said overcurrent sensor circuit (160); and a ballast driver circuit (140) connected to said ballast controller IC (520).

23. The electronic ballast circuit for limiting lamp strike voltage according to claim 22, wherein said overcurrent sensor circuit (160) comprises an overcurrent sense transistor (Q110) connected to an integration circuit.

24. The electronic ballast circuit for limiting lamp strike voltage according to claim 23, wherein said integration circuit comprises a sense integrator resistor (535) connected in series with a sense integrator capacitor (C129).

25. The electronic ballast circuit for limiting lamp strike voltage according to claim 22, further comprising: a sense diode (532) connected in series with sense resistor (534).

26. The ballast circuit for limiting lamp strike voltage according to claim 22, wherein said ballast controller IC (520) further comprises:

a plurality of parameter pins (511) connected to ballast controller setup sweep TC capacitor (512), a ballast controller setup sweep TC resistor 514, a ballast controller setup run frequency capacitor (516), and a ballast controller setup run frequency resistor (518).

27. The ballast circuit for limiting lamp strike voltage according to claim 22, wherein said ballast controller IC (520) further comprises:

a ballast controller switching transistor (Q103) comprising an emitter lead (546), wherein said ballast controller switching transistor (Q103) is connected to a collector resistor (R109), a ballast controller Vcc switch divider resistor (545), and a ballast controller Vcc switch divider resistor (548).

* * * * *